US005495073A

United States Patent [19]

Fujishima et al.

[11] Patent Number: 5,495,073

[45] Date of Patent: Feb. 27, 1996

[54] AUTOMATIC PERFORMANCE DEVICE HAVING A FUNCTION OF CHANGING PERFORMANCE DATA DURING PERFORMANCE

[75] Inventors: Takuya Fujishima, Hamamatsu; Kenichi Ohya, Nagano; Shingo Kawasaki, Kobe, all of Japan

[73] Assignee: Yamaha Corporation, Japan

[21] Appl. No.: 62,938

[22] Filed: May 17, 1993

[30] Foreign Application Priority Data

May 18, 1992 [JP] Japan ..... 4-148986
May 18, 1992 [JP] Japan ..... 4-148988

[51] Int. Cl.[6] ..... G10H 7/00; G04B 13/00; A63H 5/00

[52] U.S. Cl. ..... 84/609; 84/610; 84/634

[58] Field of Search ..... 84/609–612, 626, 84/634–636

[56] References Cited

U.S. PATENT DOCUMENTS

| | | | |
|---|---|---|---|
| 4,890,527 | 1/1990 | Suzuki et al. | 84/697 |
| 4,930,390 | 6/1990 | Kellogg et al. | 84/611 |
| 4,998,960 | 3/1991 | Rose et al. | 84/622 |
| 5,274,191 | 12/1993 | Usa | 84/600 |
| 5,292,995 | 3/1994 | Usa | 84/626 |
| 5,298,677 | 3/1994 | Shimada | 84/635 |
| 5,308,915 | 5/1994 | Ohya et al. | 84/601 |
| 5,369,217 | 11/1994 | Yamashita et al. | 84/611 |

FOREIGN PATENT DOCUMENTS 2-131292 5/1990 Japan .

*Primary Examiner*—William M. Shoop, Jr.
*Assistant Examiner*—Jeffrey W. Donels
*Attorney, Agent, or Firm*—Graham & James

[57] ABSTRACT

Automatic performance data of plural channels are read from a memory, these data are interpolated by interpolation data and an automatic performance tone is generated on the basis of the interpolated automatic performance data. The interpolation data can be variably set in accordance with an operation by a player whereby the player's feeling can be reflected freely on the automatic performance in real time performance. Change data for changing the automatic performance data may be stored in a memory and this change data may be selected freely by a selective operation by the player. The selected change data may be variably controlled by an operation by the player. Plural types of change data patterns corresponding to one phrase may be stored and a sequence combination of these change data patterns may be freely set and changed. By these arrangements, an automatic performance which is rich in expression of feeling as in a live performance can be realized.

16 Claims, 7 Drawing Sheets

PATTERN SEQUENCE DATA FOR ONE MUSIC PIECE

| BAR | PERFORMANCE PATTERN | CHANGE CONTROL DATA PATTERN | | | | |
|---|---|---|---|---|---|---|
| | | I | II | III | IV | - - - |
| 0 | PD1 | CD11 | CD22 | CD12 | CD23 | - - - |
| 1 | PD2 | CD12 | CD23 | CD11 | CD11 | - - - |
| 2 | PD3 | CD11 | CD22 | CD23 | CD22 | - - - |
| 3 | PD1 | CD12 | CD22 | CD23 | CD12 | - - - |
| 4 | PD1 | CD12 | CD23 | CD23 | CD23 | - - - |
| 5 | PD2 | CD11 | CD23 | CD23 | CD11 | - - - |
| 6 | PD4 | CD11 | CD22 | CD12 | CD22 | - - - |
| - | - | - | - | - | - | - - - |
| - | - | - | - | - | - | - - - |
| - | - | - | - | - | - | - - - |
| - | - | - | - | - | - | - - - |

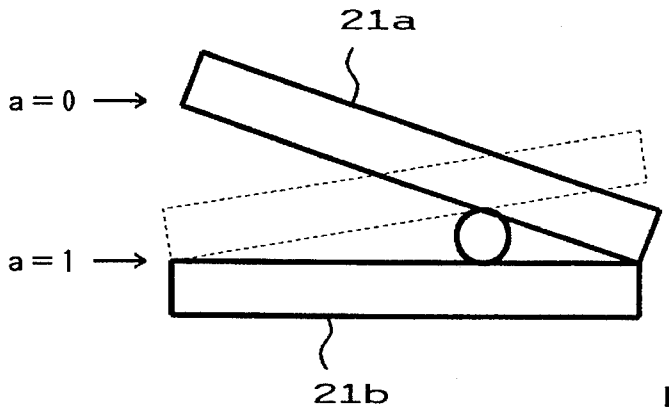
F I G. 2
| FIRST CHANNEL | |
|---|---|
| ON TIMING | OT 11 |
| NOTE NO. | NT 11 |
| GATE TIME | GT 11 |
| VELOCITY | V 11 |
| ON TIMING | OT 12 |
| NOTE NO. | NT 12 |
F I G. 3 A
| SECOND CHANNEL | |
|---|---|
| ON TIMING | OT 21 |
| NOTE NO. | NT 21 |
| GATE TIME | GT 21 |
| VELOCITY | V 21 |
| ON TIMING | OT 22 |
| NOTE NO. | NT 22 |
F I G. 3 B
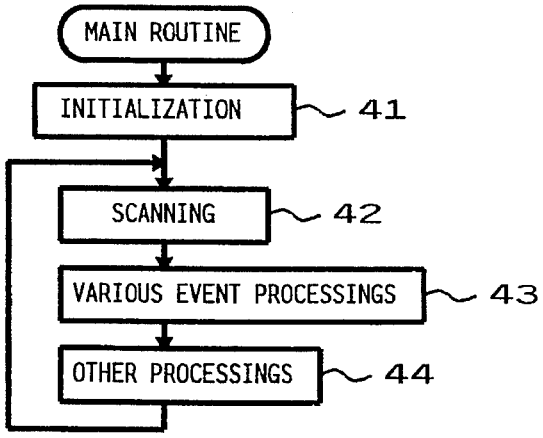
F I G. 4

PERFORMANCE DATA PATTERN PD

| ADDRESS ADR | EVENT | DATA | VELOCITY VEL |
|---|---|---|---|
| 0 | | | |
| 1 | KON | 37 | 106 |
| 2 | | | |
| 3 | KON | 42 | 98 |
| 4 | KOF | 37 | |
| 5 | PB | +8 | |
| ⋮ | ⋮ | ⋮ | ⋮ |
| 94 | KOF | 63 | |
| 95 | | | |

FIG. 7A

CHANGE DATA PATTERN CD

| ADDRESS ADR | TIMING TM | VELOCITY OFFSET VOF |
|---|---|---|
| 0 | 0 | 12 |
| 1 | 2 | 10 |
| 2 | 5 | 5 |
| 3 | 11 | −10 |
| 4 | 6 | −6 |
| 5 | −1 | 2 |
| ⋮ | ⋮ | ⋮ |
| 94 | −2 | −8 |
| 95 | 0 | −2 |

FIG. 7B

PATTERN SEQUENCE DATA FOR ONE MUSIC PIECE

| BAR | PERFOR-MANCE PATTERN | CHANGE CONTROL DATA PATTERN | | | | |
|---|---|---|---|---|---|---|
| | | I | II | III | IV | - - - |
| 0 | PD1 | CD11 | CD22 | CD12 | CD23 | - - - |
| 1 | PD2 | CD12 | CD23 | CD11 | CD11 | - - - |
| 2 | PD3 | CD11 | CD22 | CD23 | CD22 | - - - |
| 3 | PD1 | CD12 | CD22 | CD23 | CD12 | - - - |
| 4 | PD1 | CD12 | CD23 | CD23 | CD23 | - - - |
| 5 | PD2 | CD11 | CD23 | CD23 | CD11 | - - - |
| 6 | PD4 | CD11 | CD22 | CD12 | CD22 | - - - |
| ⋮ | ⋮ | ⋮ | ⋮ | ⋮ | ⋮ | ⋮ ⋮ ⋮ |

FIG. 9

AUTOMATIC PERFORMANCE DEVICE HAVING A FUNCTION OF CHANGING PERFORMANCE DATA DURING PERFORMANCE

BACKGROUND OF THE INVENTION

This invention relates to an automatic performance device such as a sequencer or an automatic rhythm performance device and, more particularly, to an automatic performance device having a data changing function for changing expression of performance as desired or in plural steps during an automatic performance.

In conventional automatic performance devices, performance data is stored in the order of performance and this performance data is sequentially read out and a tone corresponding to this performance data is generated at a predetermined timing.

When a human being plays a music, expression of performance is different each time he plays the same score for the reason that his feeling changes as the performance progresses or that he reacts to reaction of audience. For example, depending upon the performance situation, the position of accent and performance timings which can be expressed by terms "delayed-play" and "rush-play" change each time and this expands expression of the music. This expansion of expression is a benefit of a live performance.

In the conventional automatic performance devices, however, similarly to playback of a recorded music, recorded contents are reproduced precisely each time, so that they are incapable of performing an extemporaneous expression of feeling as in a live performance and hence the automatic performance made by the conventional devices tends to become monotonous.

For eliminating such monotonousness in the automatic performance by the conventional automatic performance devices, some improvements have been proposed. In the specification of Japanese Patent Laid-open No. Hei 2-131292, for example, there is disclosed a device in which not only basic performance data but also change control for changing tone characteristics or tone generation timing thereof are stored in a memory, the basic performance data and the change control data are read from the memory as the automatic performance progresses, and the tone generation timing or the tone characteristics such as velocity in the basic performance data is changed on the basis of the read out change control data. In this prior art automatic performance device, change sequence for the change control data is previously programmed in correspondence to an automatic performance sequence and, therefore, there is no consideration for causing the player's feeling to be reflected freely on an automatic performance in real time performance with a result that the automatic performance still remains unsatisfactory in extemporaneous expression of the player's feeling.

SUMMARY OF THE INVENTION

It is, therefore, an object of the invention to provide an automatic performance device capable of changing feeling of performance as the player desires during an automatic performance and thereby providing an automatic performance which is rich in extemporaneous expression of the player's feeling as in a live performance.

For achieving the above described object of the invention, an automatic performance device according to the first aspect of the invention comprises performance data memory means for storing automatic performance data of plural channels, interpolation data setting means for variably setting interpolation data for interpolating the performance data of plural channels, reading means for reading out the respective automatic performance data of plural channels, interpolation means for interpolating the read out automatic performance data of plural channels on the basis of the interpolation data, and automatic performance means for performing an automatic performance on the basis of the interpolated automatic performance data.

The reading means reads out automatic performance data of at least two channels from the performance data memory means. The read out automatic performance data of two channels are sequentially interpolated by the interpolation means and used for the tone generation processing executed by the tone generation means. At this time, the interpolation means sequentially interpolates the automatic performance data of two channels on the basis of the interpolation data set by the interpolation data setting means. Accordingly, by operation of the interpolation data setting means by the tone generation means during the tone generation to change the interpolation data suitably, contents of the automatic performance data applied to the tone generation means can be changed suitably in accordance with the operation of the interpolation data setting means whereby a desired change can be imparted to the automatic performance data and expression in the automatic performance can be expanded as in a live performance.

For achieving the above described object of the invention, an automatic performance device according to the second aspect of the invention comprises performance data memory means for storing reference performance data, change data memory means for storing plural types of change data for changing the reference performance data, a data selection operator for selecting a desired type of change data from among the plural types of change data stored in said change data memory means, data changing means for changing the reference performance data on the basis of the change data selected by said data selection operator, and automatic performance means for performing an automatic performance on the basis of the changed performance data.

During the automatic performance, the player can select desired data from among plural change data by operating the data selection operator in accordance with his feeling at that time. The data change means changes the reference performance data on the basis of the selected change data. The automatic performance means can perform the automatic performance on the basis of the changed performance data. Accordingly, the player can freely reflect his feeling on the automatic performance and thereby perform an automatic performance which is rich in expression.

For achieving the above described object of the invention, an automatic performance device according to the third aspect of the invention comprises performance data memory means for storing performance data in correspondence to a reference performance timing, change data memory means for storing change data for changing the performance timing of the performance data, and performance means for reading the performance data from said performance data memory means and the change data from said change data memory means and making a performance by changing the reference performance timing of the performance data on the basis of the read out change data, said performance means reading the performance data sooner by predetermined time length than a timing of actual performance and determining the timing of actual performance by changing the performance timing corresponding to the read out performance data by the change data.

For enabling change of a performance timing by the change data during real time performance, the performance data is read from the memory means sooner by a predetermined time length than a timing of actual performance and, by changing the performance timing corresponding to the read out performance data by the change data, a control is made so that the actual performance timing is quickened or delayed as desired.

For achieving the above described object of the invention, an automatic performance device according to the fourth aspect of the invention comprises performance data memory means for storing reference performance data, change data pattern memory means for storing plural change data patterns for changing the reference performance data, sequence memory means for storing pattern sequence information which designates sequentially the change data patterns in a predetermined order, control means for variably controlling the amount of change by the change data pattern designated by the pattern sequence information, data change means for changing the reference performance data on the basis of the variably controlled change data pattern, and automatic performance means for performing an automatic performance on the basis of the changed performance data.

By designating a desired combination of plural change data patterns in a predetermined order on the basis of the pattern sequence information, various automatic performance change patterns can be realized. Further, by variably controlling the amount of change by the change data patterns designated by the pattern sequence information, an automatic performance change control reflecting the player's will and feeling can be realized.

Embodiments of the invention will be described below with reference to the accompanying drawings.

BRIEF DESCRIPTION OF THE DRAWINGS

In the accompanying drawings,

FIG. 2 is a diagram schematically showing the manner of outputting of an angle signal for a foot pedal in FIG. 1;

FIG. 3A is a diagram showing an example of contents of performance data with respect to the first channel stored in a data and working RAM in FIG. 1;

FIG. 3B is a diagram showing an example of contents of the performance data with respect to the second channel 1;

FIG. 4 is a flow chart showing an example of a main routine executed by a microcomputer in FIG. 1;

FIG. 7A is a diagram showing an example of contents of performance data patterns stored in a program and pattern data ROM in FIG. 6;

FIG. 7B is a diagram showing an example of contents of change data patterns stored in the same ROM;

FIG. 9 is a diagram showing contents of pattern sequence data for one music piece consisting of a combination of the performance data pattern and the change data pattern of FIGS. 7A and 7B;

DESCRIPTION OF PREFERRED EMBODIMENTS

Figure 1:
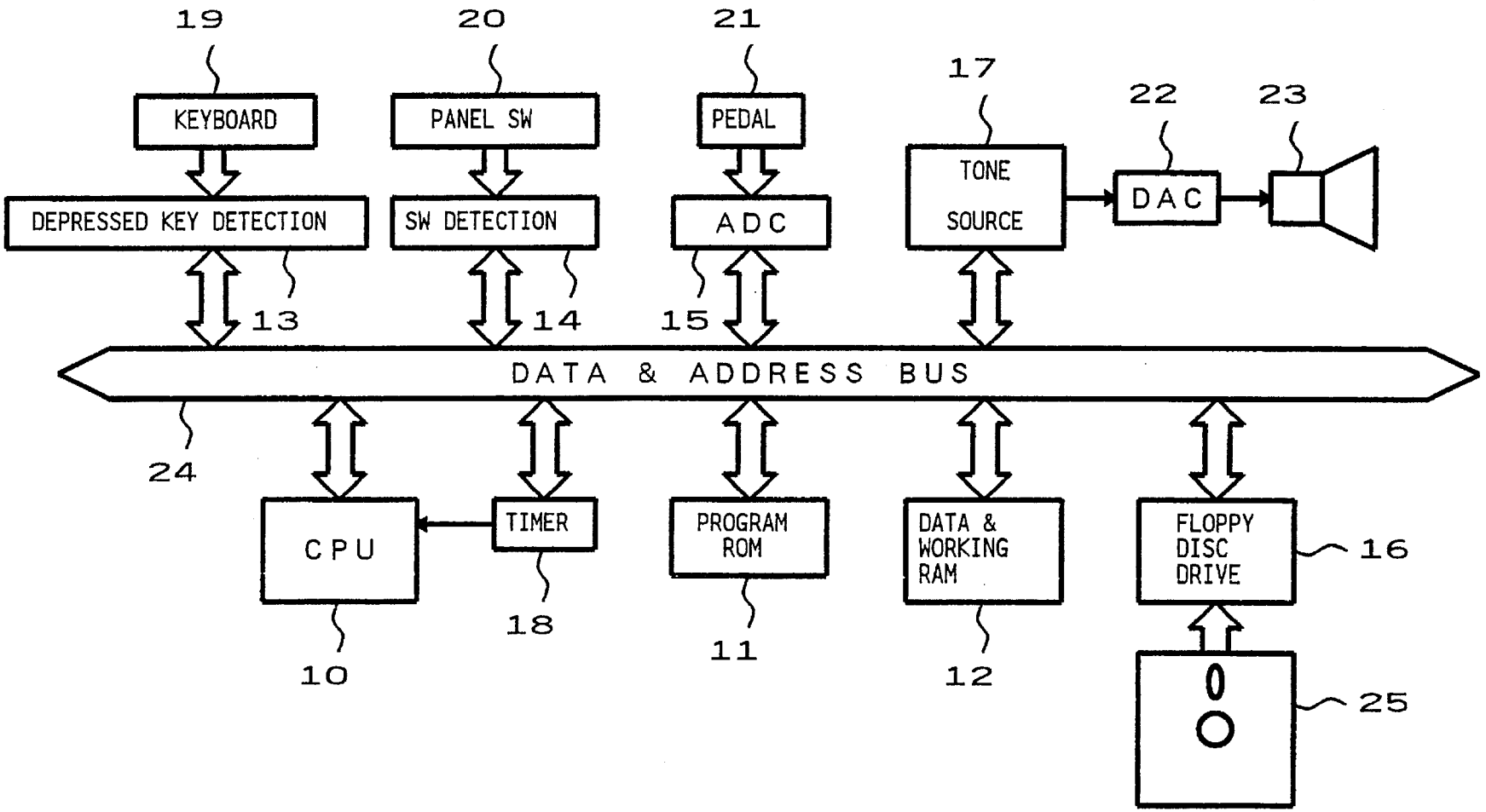
FIG. 1 is a block diagram showing a hardware structure of an embodiment of an electronic musical instrument incorporating the automatic performance device according to the invention.

FIG. 1 is a block diagram showing a hardware structure of an embodiment of an electronic musical instrument incorporating the automatic performance device according to the invention. In this embodiment, various processings are performed under the control by a microcomputer including a CPU 10, a Program ROM 11 and a data and working RAM 12.

In this embodiment, an electronic musical instrument which performs processings including a depressed key detection processing and an automatic performance processing by the single CPU 10 will be described.

A microprocessor unit (CPU) 10 controls operations of the entire electronic musical instrument. To this CPU 10 are connected via a data and address bus 24 the program ROM 11, the data and working RAM 12, a depressed key detection circuit 13, a switch detection circuit 14, an analog-to-digital converter (ADC) 15, a floppy disc drive 16, a tone source circuit 17 and a timer 18.

The program ROM 11 stores a system program of the CPU 10, automatic performance pattern data and various parameters and data concerning a tone and is constructed of a read-only memory (ROM).

The data and working RAM 12 temporarily stores performance data and various performance data and various data generated when the CPU 10 executes the program. A predetermined address area of a random access memory (RAM) is allotted as the data and working RAM 12 and utilized as registers and flags. A floppy disc 25 stores performance data for plural music pieces and performance data of a desired music piece is transferred to the data and working RAM 12 for performance of the music piece.

The keyboard 19 includes keys for selecting tone pitches of tones to be generated. Each key has a key switch corresponding thereto and, if necessary, touch detection means such as a depressing force detection unit. The keyboard 19 is a basic operator for music performance and any other performance operator may be used.

The depressed key detection circuit 13 includes a key switch circuit provided for each of keys in the keyboard 19 designating the tone pitch of a tone to be generated. This depressed key detection circuit 13 detects a change in the keyboard 19 from a key-off state to a key-on state and thereupon outputs a key-on event. The depressed key detection circuit 13 detects also a change from a key-on static to a key-off state and there-upon outputs a key-off event. Simultaneously with out-putting of a key-on even or a key-off event, the depressed key detection circuit 13 produces a key code (note number) representing the tone pitch of a key on which the key-on event or the key-off event has taken place. The depressed key detection circuit 13 produces also velocity data and after ouch data upon detecting the key depressing speed or key depressing force during depression of a key.

The switch detection circuit 14 is provided for each operator (i.e., switch) provided in a panel switch 20 and outputs operation data corresponding to an operation state of each of these operators as event information.

The panel switch 20 includes various operators for selecting, setting or controlling tone color, tone volume, tone pitch and effects.

A foot pedal 21 is a type of operator which is operated by a foot of a player. The foot pedal 21 includes a movable member 21*a* and a stationary member 21*b* and produces an analog angle signal a corresponding to an operation angle formed between the movable member 21*a* and the stationary member 21*b*.

An analog-to-digital converter 15 converts the analog angle signal provided by the foot pedal 21 to a digital pedal signal a indicating a value of 0 to 1. The analog-to digital converter 15 provides a pedal signal a which is "1" when the amount of depression of the foot pedal 21 is at the maximum, a pedal signal a which is "0" when the amount of depression is at the minimum, i.e., when the foot pedal is not depressed at all, and a pedal signal a which is some value between 0 and 1 when the amount of depression is some value between the maximum and minimum The tone source circuit 17 can generate tone signals simultaneously in a plurality of channels. The tone source circuit 17 inputs performance data (data based on the MIDI standard) provided through the data and address bus 24 and generates a tone signal on the basis of this performance data.

Any system may be employed as a tone signal generation system in the tone source circuit 17. For example, a memory accessing system in which tone waveform sample value data stored in a waveform memory is successively read out in accordance with address data which changes in accordance with the tone pitch of a tone to be generated, an FM system in which tone waveform sample value data is obtained by performing a predetermined frequency modulation operation using the address data as phase angle parameter, or an AM system in which tone waveform sample value data is obtained by performing a predetermined amplitude modulation operation using the address data as phase angle parameter may be employed as desired.

A tone signal generated by the tone source circuit 17 is sounded as a tone through a digital-to-analog converter (DAC) 22 and a sound system 23 (including amplifier and loudspeakers).

The timer 18 is provided for counting time interval and producing a tempo clock pulse for setting a tempo of automatic performance. The frequency of this tempo clock pulse is adjusted by a tempo switch (not shown) in the panel switch 20. The produced tempo clock pulse is supplied to the CPU 10 as an interrupt command and the CPU 10 performs various processings of the automatic performance by the interrupt processing.

FIGS. 3A and 3B show contents of the performance data which is transferred from the floppy disc 25 to the data and working RAM 12 through the floppy disc drive 16 and the data and address bus 24. Performance data of plural channels are stored in the data and working RAM 12 and FIG. 3A shows contents of a part of performance data of the first channel and FIG. 3B contents of a part of performance data of the second channel respectively.

The performance data is stored on an event basis. Contents of a tone are expressed by on timing OT, note number NT, gate time GT and velocity V. The on timing OT is data representing tone generation timing for each tone and is expressed by a numerical value representing timing from the beginning of each bar. The note number NT is data representing tone pitch of a tone to be generated. The gate time GT is data representing time length of tone generation (i.e., time from note-on till note-off). The velocity V is data representing tone volume of the tone.

Performance data of the first tone in the first channel, for example, is composed of on timing OT11, note number NT11, gate time GT11 and velocity V11. Performance data of the second tone in the first channel is composed of on timing OT12, note number NT12, gate time GT12 and velocity 12. Subsequently, similar performance data is stored in the data and working RAM 12 in the order of occurrence of the event.

Performance data of the first tone of the second channel is composed of on timing OT21, note number NT21, gate time GT21 and velocity V21. Performance data of the second tone is composed of on timing OT22, note number NT22, gate time GT22 and velocity V22. Subsequently, similar performance data is stored in the data and working RAM 12 in the order of occurrence of the event.

In a case where performance data of the first channel only is performed, the performance data of the first tone of the first channel is read out and a tone generation processing of a tone corresponding to the note number NT11 and the velocity V11 is performed at a timing of the on timing OT11. Then, the performance data of the second tone is read out and a tone generation processing of a tone corresponding to the note number NT12 and the velocity V12 is performed at a timing of the on timing OT12. Subsequently, in like manner, performance data of the first channel is successively read out and corresponding tone generation processings are performed. During this time, time at the gate time GT11, GT12, . . . from the beginning of tone generation is counted and a tone which has continued during time corresponding to its gate time is extinguished (key-off processing).

Likewise, in a case where performance data of the second channel only is performed, the performance data of the first tone and the performance data of the second tone of the second channel are read out successively and a tone generation processing of a tone corresponding to the note number NT21 and the velocity V21 is performed at a timing of the on timing OT21 and then a tone generation processing of a tone corresponding to the note number NT22 and the velocity V22 is performed at a timing of the on timing OT22. During this time, time of the gate time GT21, GT22, . . . from the beginning of tone generation is counted and a tone which has continued during time corresponding to its gate time is extinguished (key-off processing).

In this embodiment, a change control of expression in the automatic performance is achieved by interpolating on timing OT, gate timeGTand velocity V of performance data of the first channel and those of the second channel having different styles of expression and thereby producing new performance data having an intermediate expression.

An example of processings of an automatic performance device executed by the microcomputer (CPU 10) will now be described with reference to the flow charts of FIGS. 4 and 5.

FIG. 4 shows an example of a main routine executed by the microcomputer.

Upon turning on of a power, the CPU 10 starts a processing corresponding to a control program stored in the program ROM 11. In "initialize processing", registers and flags provided in the data and working RAM 12 are initialized (step 41).

After the "initialize" processing, the switch detection circuit 14 and the analog-to-digital converter 15 (pedal 21) are scanned to detect data including presence or absence of a switch-on event and amount of operation of the switch (step 42). Then, "various event processings" corresponding to the detected event and amount of operation are performed (step 43). In "other processings", various processings including processings based on operation of other operators in the panel switch and tone volume change and performance processing by the keyboard 19 (depressed key detection circuit 13) are performed (step 44).

For performing the automatic performance immediately after turning on of a power, it is necessary to provide performance data in the data and working RAM 12 by either transferring performance data of a desired music piece from the floppy disc 25 or real time writing or step writing. Since, however, this operation is well known, description will be made below on the assumption that performance data is already stored in the data and work RAM 12.

Figure 5:
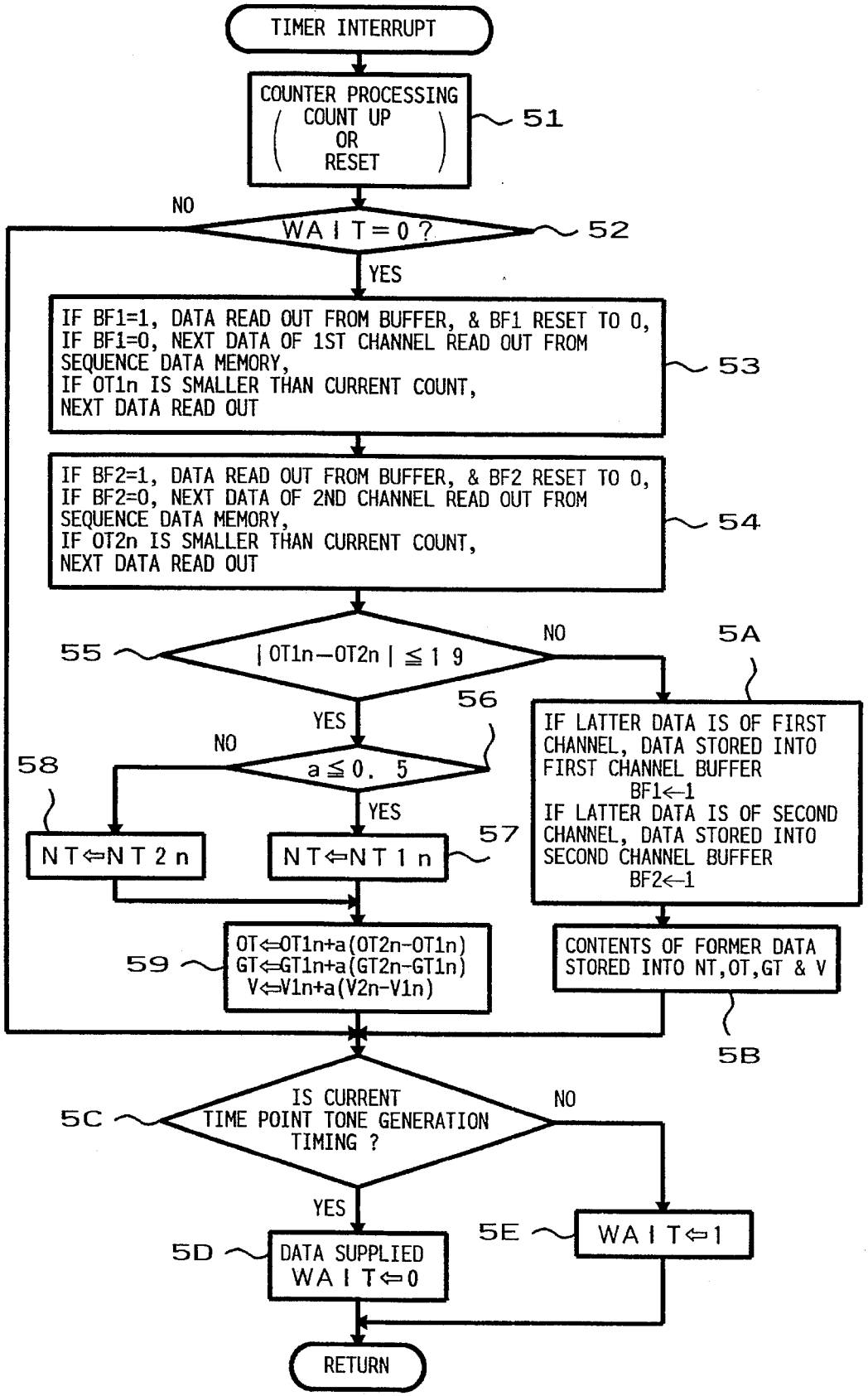
FIG. 5 is a flow chart showing a timer interrupt processing executed at the rate of 96 interruptions per a crotchet in order to perform a tone generation processing by successively reading out the performance data as shown in FIGS. 3A and 3B.

FIG. 5 shows a timer interrupt processing performed at the rate of 96 interruptions per a crotchet in order to successively read out performance data of the first channel and the second channel as shown in FIGS. 3A and 3B. This timer interrupt processing is performed in the following steps one by one:

Step 51: In a count processing, a bar count processing is performed for counting up which bar is currently performed and, further, a beat count processing is performed for counting up which position in the bar is currently performed. In the beat count processing, the count is reset each time the bar is changed.

Step 52: Whether or not a wait flag WAIT is "0" is detected. When the result is "0" (YES), the routine proceeds to next step 52 and when the result is "1" (NO), the routine jumps to step 5C. The wait flag WAIT indicates whether or not processings of steps 53 to 5B are performed, i.e., whether or not performance is newly read out and an interpolation operation is performed. When the performance data is supplied to the tone source circuit 17 in step 5D, the wait flag WAIT is reset to "0" and otherwise remains to be set to "1" through a processing of step 5E.

Step 53: Whether or not a first buffer register BF1 is "0" is detected. When the buffer register BF1 is "1", performance data (on timing OT1n, note number NT1n, gate time GT1n and velocity V1n) is read from the first channel buffer and the first buffer register BF1 is reset to "0". Conversely, when the first buffer register BF1 is "0⇆, this signifies that performance data has been read from the first channel buffer in a preceding processing and, therefore, next performance data of the first channel is read from a sequence data memory (data and working RAM 12). Whether or not the on timing OT1n in the performance data of the first channel read from the first channel buffer or the sequence data memory is smaller than the current count is detected and, when it is smaller, this data is ignored and next performance data is read out. This processing is made for coping with a case where waiting time sometimes becomes longer than the on timing of next data depending upon result of an interpolation operation to be described later. This operation will be described more fully later. Thus, until performance data having on timing OT1n which is larger than the current count is read out, the performance data of the first channel is successively read from the first channel buffer or the sequence data memory.

Step 54: In this step, processings similar to those in step 53 are performed with respect to data of the second channel. More specifically, whether or not a second buffer register BF2 is "1" or "0" is detected. When the second buffer register BF2 is "1", performance data (on timing OT2n, note number NT2n, gate time GT2n and velocity V2n) is read from the second channel buffer and the second buffer register BF2 is reset to "0". Conversely, when the second buffer register BF2 is "0", next performance data of the second channel is directly read from the sequence data memory. Whether or not the on timing OT2n in the performance data of the second channel read from the second channel buffer or the sequence data memory is smaller than the current count is detected and, when it is smaller, this data is ignored and next performance data is read out. Thus, performance data of the second channel is successively read from the second channel buffer or the sequence data memory until performance data having on timing OT2n which is larger than the current count is read from the data and working ram 12.

Step 55: Whether or not an absolute value of difference between the on timing OT1n of the performance data of the first channel and the on timing OT2n of the performance data of the second channel read out in steps 53 and 54 is "19" or below is detected. The value "19" is a threshold value provided for distinguishing whether the notes are those to be sounded simultaneously or those to be sounded separately. In case the absolute value is "19" or below (YES), the routine proceeds to step 5A whereas in case the absolute value is larger than "19" (NO), the routine proceeds to step 5A. That is, when the tone generation timing of the performance data of the first channel (on timing OT1n) read out in step 53 and the tone generation timing of the performance data of the second channel (on timing OT2n) read out in step 54 are larger than time interval corresponding to "19", they are treated as notes to be sounded at separate timings and, without interpolating the two performance data, the routine proceeds to step 5A for subjecting the performance data of a smaller tone generation timing to a tone generation processing. Otherwise, the two performance data are treated as former data and latter data of one and single note and processings or steps 56 to 59 are made for interpolating these performance data. The numerical value "19" is used by way of example from the standpoint that it is a practical numerical value which is shorter than "24" which is length of a sixteenth note and longer than "12" which is length of a thirty second note. The numerical value is not limited to "19" but it may be changed depending upon melody or may be variably set as desired.

Step 56: Whether or not the pedal signal a is "0.5" or below is detected. When the result is "0.5" or below (YES), the routine proceeds to step 57 and when the result is not "0.5" or below (NO), the routine proceeds to step 58. That is, which of the note number NT1n of the first channel and the note number NT2n of the second channel should be used as note data is determined in accordance with the amount of operation of the foot pedal 21.

Step 57: Since the pedal signal a is "0.5" or below, the note number NT1n of the first channel is stored in the note register NT.

Step 58: Since the pedal signal a is larger than "0.5", the note number NT2n of the second channel is stored in the note register NT.

Step 59: Respective on timings, gate times and velocities of the performance data of the first and second channels are interpolated in accordance with the value of the pedal signal a and interpolated values are stored in respective on timing registers OT, gate time registers GT and velocity registers V. More specifically, the value of the on timing OT1n of the performance data of the first channel is subtracted from the value of the on timing OT2n of the performance data of the second channel, the value of the pedal signal a is multiplied with the difference and the product is stored as a final on timing in the on timing register OT. The same operation is performed with respect to the gate time and velocity and results of the operations are stored in the gate time register GT and the velocity register V. By this arrangement, when the pedal 21 is not depressed at all so that the pedal signal a is "0", the same data as the data of the first channel is formed. When the pedal 21 is depressed to the maximum, the same data as the data of the second channel is formed. When the pedal 21 is depressed to an intermediate degree, interpolation data is formed according to the degree of depression. Since there is a case where a tone pitch does not become musically desirable after interpolation, the note number NT representing the tone pitch is selected either from the first channel or the second channel.

Step 5A: In this case, as a result of detection in step 55, it has been found that the tone generation timing of t he performance data of the first channel (i.e., on timing OT1n) and the tone generation timing of the performance data of the second channel (i.e., on timing OT2n) are separated from each other by a time interval which is longer than a predetermined time interval and, therefore, the two notes should be sounded separately without obtaining single data by interpolation. Accordingly, which is the performance data of the later tone generation timing, i.e., the performance data of the larger on timing ! (latter data) is detected and contents of this performance data is stored in a buffer. More specifically, when the performance data of the larger on timing (latter data) is the first channel data, the contents of the performance data are stored in the first channel buffer and "1" is set in the first buffer register BF1. Conversely, when the performance data of the larger on timing (latter data) is the second channel data, the contents of the performance data are stored in the second channel buffer and "1" is set in the second buffer register BF2.

Step 5B: Contents of the performance data of the smaller on timing (former data) are stored in the note number register NT, on timing register OT, gate time register GT and velocity register V. This processing is made for subjecting the performance data of the smaller on timing in step 5D.

Step 5C: The value of the counter after being counted in step 51 is compared with the value of the on timing register OT and whether or not the current time point is the tone generation timing, i.e., whether or not there is coincidence between the value of the counter and the value of the on timing register OT, is detected and, when there is coincidence (YES), the routine proceeds to step 5D and, when there is no coincidence (NO), the routine proceeds to step 5E.

Step 5D: The values stared in the respective registers (the note number register NT, gate time register GT and velocity register V) are supplied to the tone source circuit 17 for tone generation and the wait flag WAIT is set to "0".

Step 5E: The wait flag WA1T is set to "1".

An example of an operation following the flow chart of FIG. 5 will now be described.

After performing the count processing (i. e., bar count processing and beat counter processing) in step 51, when the wait flag WAIT is detected to be "0" (YES) in step 52, the performance data of the first channel and the second channel as shown in FIGS. 3A and 3B are read out in steps 53 and 54.

It is assumed now: that on timing OT1n of the performance data of the first channel is "4", note number NT11 is "37" gate time GT11 is "20" and velocity V11 is "118". and that on timing OT21 of the performance data of the second channel is "9", note number NT21 is "42", gate time GT21 is "30" and velocity V21 is "98" and the pedal signal a is "0.4". It is also assumed that the on timings OT11 and OT21 are both larger than the current count.

In step 55, an absolute value "5" is calculated from the calculation of 4–9=–5 as an absolute value of difference between the on timing OT11 of the first channel and the on timing OT21 of the second channel. This absolute value "5" is below the predetermined value "19" and, therefore, the routine proceeds to step 55. Since the pedal signal a is below "0 5" the routine proceeds to step 57. In step 57, "37" of the note number NT11 of the first channel is stored in the note number register NT.

The processing of step 59 is performed whereby, as the value of on timing, "6" is calculated from the calculation of 4+0.4×(9–4)=6 and this value "6" is stored in the on timing register OT as new on timing.

As the value of gate time, "24" is calculated from the calculation of 20+0.4×(30–20)=24 and this value "24" is stored in the gate time register GT as new gate time.

As the value of velocity, "110" is calculated from the calculation of 118+0.4×(98–118)=110 and this value "110" is stored in the velocity register V as new velocity.

In step 5C, the value "6" of the on timing register OT is compared with the value of the counter. Since the two values do not coincide with each other (NO), "1" is set in the wait flag WAIT in step 5E and the routine returns. The processings of steps 51, 52, 5C and 5E are repeated until the value of the counter becomes "6" which is the value of the on timing register OT by the count processing in step 51.

Upon coincidence of the value "6" of the on timing register OT with the value of the counter, "37" of the note number register NT, "24" of the gate time register GT and "110" of the velocity register V are supplied to the tone source circuit 17 for tone generation and the wait flag WAIT is reset to to "0".

If on timing OT12 of next data of the first channel is "5", a time point at which tone should be generated will be passed while waiting for a value "6" which is a value of OT after interpolation. Accordingly, as described previously, in steps 53 and 54, a value which is smaller than the current counter value is ignored.

A case where the absolute value of difference between the on timing of the performance data of the first channel and the on timing of the performance data of the second channel is larger than "19" will now be described.

It is assumed now that the on timing OT11 of the performance data of the first channel is "4", the on timing OT21 of the performance data of the second channel is "24" and other data are the same as the above described case.

In step 55, as an absolute value of difference between the on timing OT11 of the first channel and the on timing OT21 of the second channel, "20" is calculated from the calculation of 4–24=–20. Since this absolute value "20" is larger than the predetermined value "19", the routine proceeds to step 5A. In the performance data of the first channel and the second channel, it is the performance data of the second channel that has a larger on timing value and, therefore, the performance data of the second channel is all stored in the second channel buffer and "1" is set in the second buffer register BF2. In step 5B, data of the smaller on timing value, i.e., the performance data of the firs channel, is stored in the on timing :register OT, note number register NT, gate time register GT and velocity register V. Accordingly, "4" is stored in the on time register OT, "37" in the note number register NT, "20" in the gate time register GT and "118" in the velocity register V.

In step 5C, "4" which is the value of the on timing register OT is compared with the value of the counter. Since the two values do not coincide with each other (NO), "1" is set in the wait flag WAIT in step 5E and the routine returns. The processings of steps 51, 52, 5C and 5E are repeated until the value of the counter becomes "4" which is the value of the on timing OT by the count processing of step 51.

Upon coincidence of the value "4" of the on timing register OT with the value of the counter, "37" of the note number register NT, "20" of the gate time register GT and "118" of the velocity register V are supplied the tone source circuit 17 for tone generation and the wait flag WAIT is reset to "0".

In a processing of next step 53, the first buffer register BF1 is "0" and, therefore, data of the first channel is read from the sequence data memory and, in a processing of step 54, the second buffer register BF2 is "1" and, therefore, the performance data stored in step 5A is read from the second channel buffer. Subsequently, the same processings are repeated.

Another embodiment of the invention will be described below with reference to FIG. 6 and subsequent figures.

Figure 6:
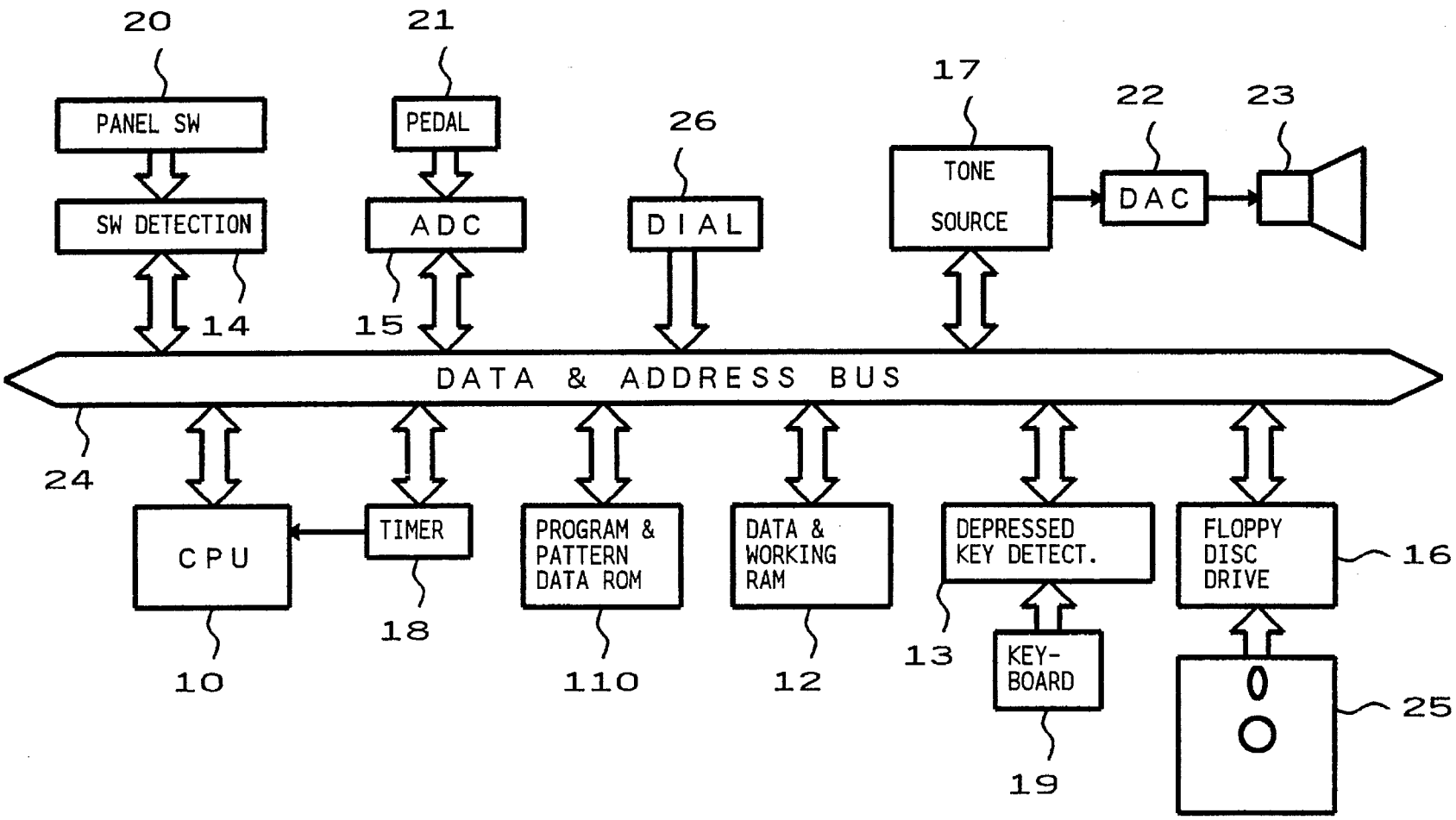
FIG. 6 is a block diagram showing a hardware structure of another embodiment of an electronic musical instrument incorporating the automatic performance device according to the invention.

In the embodiment of FIG. 6, block elements of the same reference characters as those of FIG. 1 represent the same component parts so that description thereof will be omitted. The embodiment of FIG. 6 is different from the embodiment of FIG. 1 mainly in the provision of a dial 26 is provided and in respect of contents of a program and pattern data stored in a ROM 110. The dial 26 is a kind of operator operated by the player and outputs digital dial numbers "1", "11", "111" etc. in accordance with operation thereof.

FIGS. 7A and 7B show mainly contents of a performance data pattern PD and a change data pattern CD stored in a program and pattern data ROM 110. The performance data pattern PD has data for one bar in all and an address ADR is assigned to each timing in one bar (96 addresses in this embodiment). Performance data for one address of the performance data pattern PD consists of an event section containing contents of an event, a data section containing data relating to the event and a velocity section containing velocity VEL when the event is a key-on event.

For example, at address "1" of the performance data pattern PD, there are stored event data "KON" representing key-on, data "37" representing its note number and data "106" representing its velocity VEL. In a normal performance processing, when the data at this address "1" have been read out, a tone generation processing of a tone corresponding to the note number "37" and the velocity "106" is performed upon lapse of a predetermined period of time DO (time corresponding to a quarter beat) from the timing of reading of the data. Similarly, at address "3" of the performance data pattern PD, there are stored data "KON" representing key-on, data "42" representing its note number and data "98" representing its this address "3" have velocity VEL. When the data at been read out, a tone generation processing of a tone corresponding to the note number "42" and the velocity "98" is performed upon lapse of the predetermined period of time DO from the timing of reading of the data.

At address "4" of the performance data pattern PD, there are stored data "KOF" representing key-off and data "37" representing its note number. A tone generation processing of a tone corresponding to the note number "37" is changed to a tone extinguishing processing upon lapse of the predetermined period of time PO by reading out of this data at address "4".

The change data pattern CD contains data for one bar and, similarly to the performance data pattern PD, 96 addresses are assigned to respective timings in one bar. Change data for one address in the change data pattern CD consists of a timing section having a timing change value TM representing change of a tone generation timing, and a velocity offset section having a velocity offset value VOF.

For example, at address "0" of the change data pattern CD, there are stored data "0" as the timing change value and data "12" as the velocity off set value VOF. Change of a tone generation timing is not made by the data of "0" of the change data pattern CD but a change processing of velocity VEL is made. Since, however, no performance data exists at address "0" of the performance. data pattern in the embodiment of FIGS. 7A and 7B, data at address "0" read from the change data pattern CD has no particular significance.

At address "1" of the change data pattern, there are stored data "2" as the timing change value and data "10" as the velocity offset value VOF. By the change data at address "1" of the change data pattern CD, the performance data at address "1" of the performance data pattern PD is processed after being delayed from a normal processing by time length corresponding to the timing change value "2" at the maximum and, further, velocity "106" at address "1" of the performance data pattern PD increases by "10" at the maximum and becomes "116". The qualification "at the maximum" is made because the effect of the change value is controlled in accordance with the amount of depression of the pedal in a processing to be described later as will be described more fully later. When data at address "1" have been read from the performance data pattern PD and the change data pattern CD, a tone generation processing of a tone having a tone pitch corresponding to the note number "37" is performed in correspondence to one of velocities of "106" to "116" upon lapse of the predetermined period of time P0 from its reading timing and with a delay of time length corresponding to the timing change value "2" at the maximum in accordance with the amount of depression of the pedal 21.

Similarly, at address "2" of the change data pattern CD, there are stored data "5" as the timing change value and data "5" as the velocity offset value VOF. By the change data at this address "2" of the change data pattern CD, the performance data at address "2" of the performance data pattern PD is processed after being delayed from the normal processing by time length corresponding to the timing change value "5" at the maximum and velocity VEL increases by "10" at the maximum. Since, however, no performance data exists at address "2" of the performance data pattern PD, the change data pattern CD at address "2" has no particular significance.

Then, at address "3" of the change data pattern CD, there are stored data "11" as the timing change value and data "–10" as the velocity offset value VOF. By the change data at address "3" of the change data pattern CD, the performance data at address "3" of the performance data pattern PD is processed after being delayed from the normal processing by time length corresponding to the timing change value "11" at the maximum and the velocity. "98" decreases by "10" at the maximum and becomes "88". That is, when data at address "3" is read from the performance data pattern PD and the change data pattern CD, a tone generation processing of a tone having a tone pitch corresponding to the note number "42" is performed in accordance with one of velocities "98" to "88" upon lapse of the predetermined period of time DO after its reading timing and with a timing which is delayed by time length corresponding to the timing change value "11" at the maximum in avoidance with the amount of depression of the pedal 21.

Similarly, at address "4" of the change data pattern CD, there are stored data "6" as the timing change value and "–6" as the velocity offset value VOF. By the change data at address "1" of the change data pattern CD, the performance data at address "4" of the performance data pattern PD is processed after being delayed from the normal processing by time length corresponding to the timing change value "6" at the maximum and the velocity VEL decreases to "6" at the maximum. That is, when data at address "4" has been read from the performance pattern data PD and the change data pattern CD, a tone extinguishing processing of a tone corresponding to the note number "37" is performed upon lapse of the predetermined period of time PO and at a timing which is delayed by time length corresponding to the timing change value "6" at the maximum in accordance with the amount of depression of the pedal 21. In this case, the velocity change value "–6" of the change data has no particular significance.

Then, at address "5" of the change data pattern CD, there are stored data "–1" as the timing change value and data "2" as the velocity offset value VOF. By the change data at address "5" of the change data pattern CD, the processing at address "5" of the performance data pattern PD is performed at a processing timing which is earlier than the normal processing by time length corresponding to the timing change value "1" at the maximum and the velocity VEL also increases by "2" at the maximum. That is, when data of address "5" has been read from the performance pattern data PD and the change data pattern CD, a pitch bend processing is performed at a timing which is obtained by subtracting time length corresponding to the timing change value "1" at the maximum in accordance with the amount of depression of the pedal 21 from the timing at which the predetermined period of time PO has elapsed from reading of the data. In this case, the velocity change value "–6" in the change data has no particular significance.

At addresses 6 to 94 of the change data pattern CD are stored change data of similar contents.

Different from the performance data pattern PD, data representing the timings change value TM and data representing the velocity offset value VOF are stored at all addresses of the change data pattern CD. This is an arrangement made for enabling a proper change control with respect to the performance pattern data of any structure.

In the above described example, description has been made with respect to a case where the change data is a negative value with respect to a processing timing for pitch bend data PB. In a case where the change data is a negative value with respect to a processing timing of key-on or key-off, the processing is made similarly in a shorter waiting time than the predetermined period of time PO.

Figure 8A:
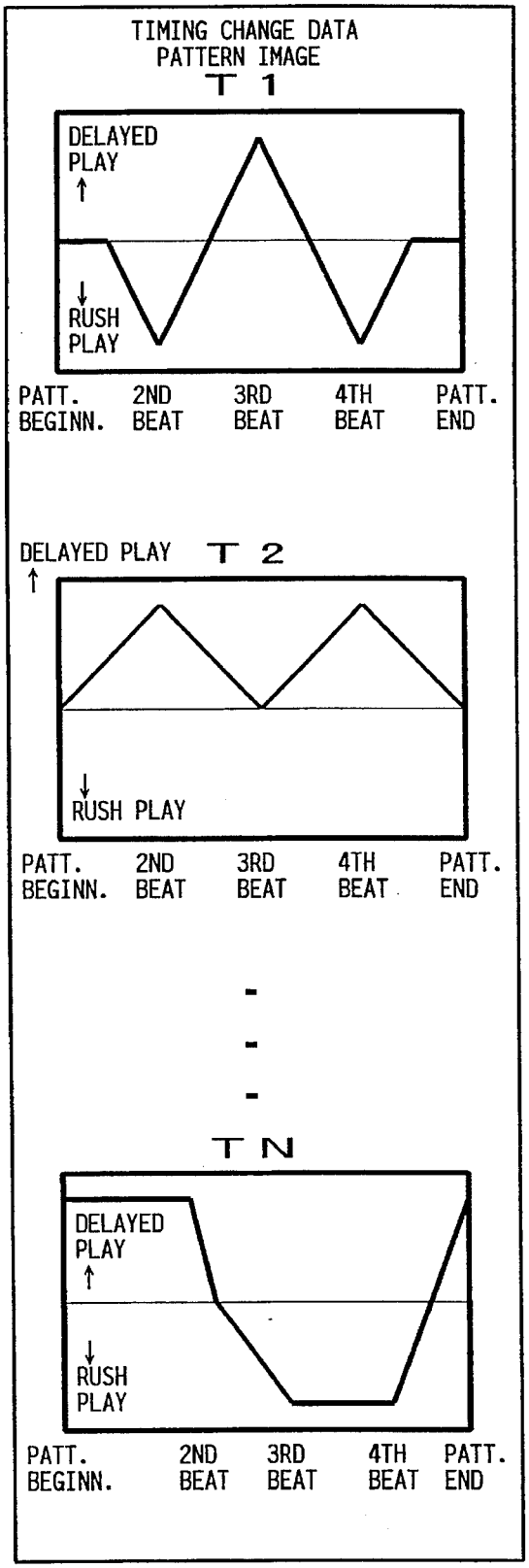
FIG. 8A is a diagram showing examples of contents of some of the change data patterns in their image in accordance with the timing change data.
Figure 8B:
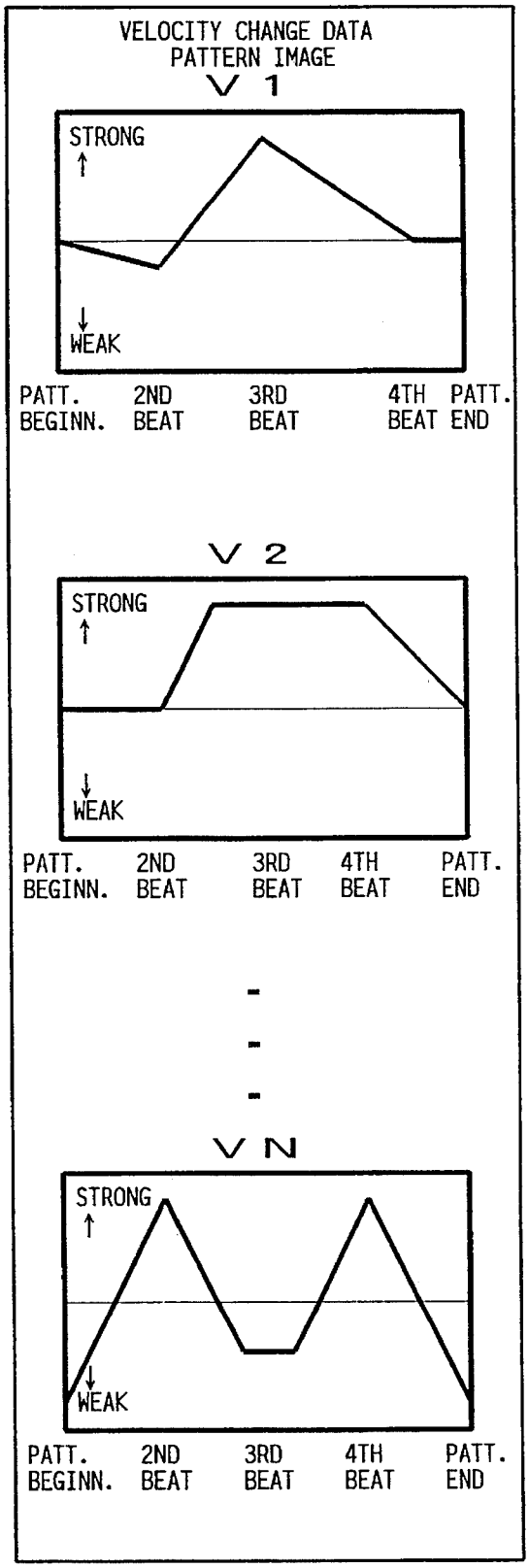
FIG. 8B is a diagram showing examples of contents of some of the change data patterns in their image in accordance with velocity change data.

FIGS. 8A and 8B show examples of contents of some of the change data patterns CD in their image. FIG. 8A shows examples of some timing data pattern image T1 to TN and FIG. 8B shows examples of some velocity change data pattern images V1 to VN. In each pattern image figure of FIG. 8A, the horizontal axis shows address ADR (see FIG. 7B) and the vertical axis shows a timing change value TM corresponding to the address ADR. Similarly, in each pattern image figure of FIG. 8B, the horizontal axis shows address ADR and the vertical axis a velocity offset value VOF corresponding to the address ADR.

FIGS. 8A and 8B show change patterns at a four-four time and, therefore, the first address "0" corresponds to the pattern beginning (first beat), address "24" to the second beat, address "48" to the third beat, address "72" to the fourth beat and last address "95" to the pattern end (the end of the fourth beat).

A positive timing change value TM in timing change data pattern images T1, T2 to TN represents that a processing is performed which is delayed from a normal processing and it gives an impression of "delayed-play" in the music whereas a positive timing change value TM represents that a processing is performed which is advanced from a normal processing and it gives an impression of "rush-play" in the music.

A positive velocity offset value VOF in the velocity change data pattern images V1, V2 to VN represents increase in the velocity VEL and a negative velocity offset value VOF represents decrease in the velocity VEL.

According to the timing change data pattern T1 of FIG. 8A, for example, there is no change in timing in performance data in the vicinity of the first beat. Performance data in the vicinity of the second beat is changed to have some rush-play, performance data in the vicinity of the third beat is changed to have some delayed-play and performance data in the vicinity of the fourth beat changed to have some rush-play. Similarly, in a case where velocity is made to correspond particularly to tone volume, according to the change data pattern V2, no change in velocity is made from the vicinity of the pattern beginning to the vicinity of the second beat and, as to data from the vicinity of the second beat to the pattern end, performance data is changed so that an emphasis will be given by increasing the velocity.

By combining properly the timing change date pattern images T1, T2 to TN with the velocity change data pattern images V1, V2 to VN, various change data patterns CD can be prepared. For example, a change data pattern CD11 is made by combining the timing change data pattern image T1 with the velocity change data pattern image V1. A change data pattern CD22 is made by combining the timing change data pattern image T2 with the velocity change data pattern image V2. A change data pattern CDNN is made by combining the timing change data pattern image TN with the velocity change data pattern image VN.

FIG. 9 shows contents of sequence data for one music piece consisting of a combination of the performance data pattern PD and the change data pattern CD shown in FIGS. 7A and 7B.

The pattern sequence data for one music piece may be prepared by the player according to a predetermined method or, alternatively, pre-fabricated pattern sequence data for several music pieces may be stored in a floppy disc 25 and transferred as necessary to the data and working RAM 12.

In the column of the order of the performance data pattern figure, the numbers of performance data patterns are stored in the order of performance. In this embodiment, performance data patterns are performed in the order of PD1, PD2, PD3, FD1, PD1, PD2, PD4 . . .

In the column of the change control data pattern, patterns corresponding to dial numbers I, II , III, IV, . . . are stored in the order of performance so that the player can select it properly by operating the dial 26 (FIG. 6) as desired in accordance with contents of the change data. For example, in the case of the dial number I, patterns CD11, CD12, CD11, CD12, CD12, CD11, CD11, . . . are sequentially read out as the change data patterns in correspondence to the performance data pattern. In the case of the dial number II, patterns CD22, CD23, CD22, CD22, CD23, CD23, CD22, . . . are sequentially read out. In the case of the dial number III, patterns CD12, CD11, CD23, CD23, CD23, CD23, CD12, . . . are sequentially read out. In the case of the dial number IV, patterns CD23, CD11, CD22, CD12, CD23, CD11, CD22, . . . are sequentially read OUt.

Accordingly, by operating the dial 26 and thereby changing the dial number during performance in the order of the performance data pattern, contents of the change data can be changed in real time so that the feeling of a music piece being performed can be freely changed by the dial operation by the player.

An example of processing by the automatic performance device executed by the microcomputer (CPU10) will be described with reference to the flow charts of FIGS. 10 and 11.

Figure 10:
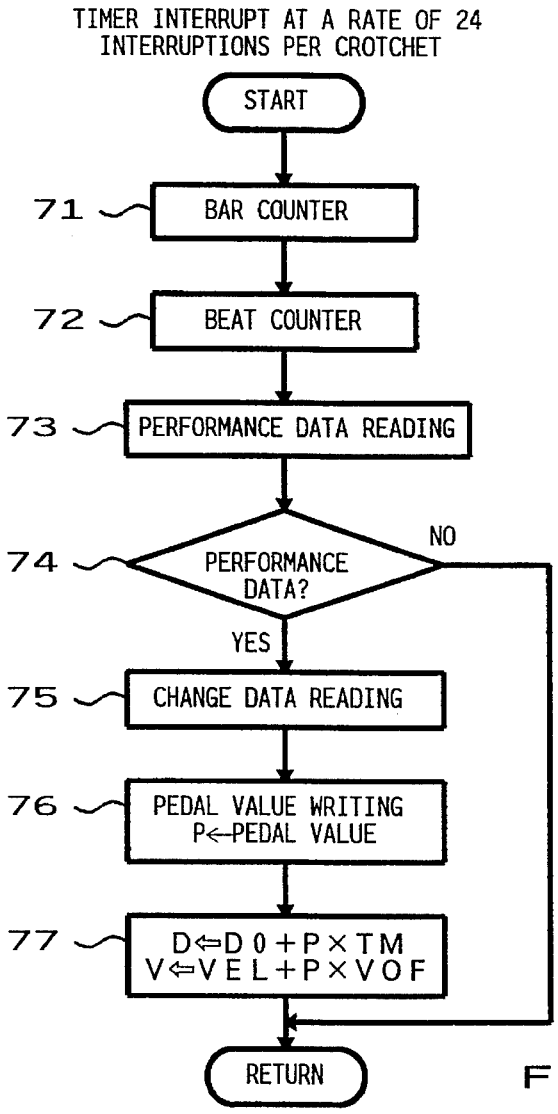
FIG. 10 is a flow chart showing a timer interrupt processing executed at the rate of 24 interruptions per a crotchet in order to successively read out performance pattern data.

FIG. 10 shows a timer interrupt processing performed at the rate of 24 interruptions per a crotchet in order to succesively read out the performance data pattern PD of FIG. 7A. It is now assumed pattern sequence data for one music piece as shown in FIG. 9 has al ready been transferred from a floppy disc to the data and working RAM 12 and stored herein by a predetermined switch operation. This processing is performed sequentially in the following steps:

Step 71: In a bar count processing, which bar is presently performed is counted. That is, countup is made each time performance of one bar has finished. By referring to the pattern sequence data in the data and working RAM 12 by using this count as a bar number, the performance data pattern of the currently performed performance data is identified.

Step 72: In a beat counter processing, which position in a bar, i.e., which address among the 96 addresses as i n the performance data pattern of FIG. 3, is accessed for tone generation is counted. This address is counted up each time the timer interrupt is made. Upon reaching 95, the counting is repeated from 0 again. The bar count is counted up when this beat counter is reset.

Step 73: In a performance data reading processing, the performance data stored at the address which is identified by the beat counter in the performance data pattern which is stored in the program and pattern data ROM 110 and identified by the bar counter is read from the program and pattern data ROM 110.

Step 74: Since, as described before, there is an address at which no performance exists in the performance data pattern, whether or not the data which has been read out by this performance data reading processing is the performance data is detected and, when it is the performance data, next step and subsequent steps are performed. Otherwise (i.e., the data is not the performance data), the routine returns immediately.

Step 75: In a change data reading processing, the change data which is stored at the address identified by the beat counter in the change data pattern in the program and pattern data ROM 110 which is identified by referring to the pattern sequence data in the data and working RAM 12 by the bar counter and the dial number of the dial 26 is read out.

Step 76: In a pedal value writing processing, the amount of depression of the pedal 21, i .e. , the pedal value, which has been stored by the scan processing of the main routine (corresponding to step 42 of FIG. 4) is stored in the pedal register P.

Step 77: Product of multiplication of the value of the pedal register P with the timing change value TM of the change data is added to the reference delay value DO and the sum is stored in a delay register D. The delay register D is a register for indicating time length from the timing of reading of the performance data till the tone generation of the tone. The reference delay value DO is a value for delaying the tone generation timing from reading of the performance data by time length corresponding to the reference delay value DO, i.e., the predetermined time DO (time corresponding to a quarter beat), even when the timing change value TM is "0"

Product of multiplication of the value of the pedal register P with the velocity offset value VOF is added to the velocity VEL of the performance data and the sum is stored in the velocity register V.

Figure 11:
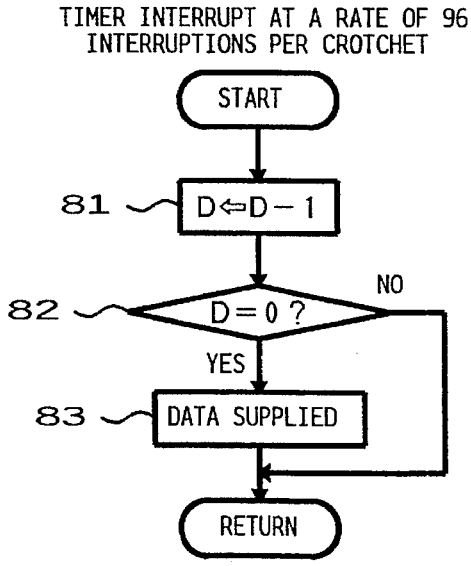
FIG. 11 is a flow. chart showing a timer interrupt processing executed at the rate of 96 interruptions per a crotchet in order to reproduce performance data read out by processings in FIG. 10.

FIG. 11 shows a timer interrupt processing performed at the rate of 96 interruptions per a crotchet in order to reproduce the performance data read by the processing of FIG. 10. This processing is performed sequentially in the following steps:

Step 81: First the delay register D is decremented by 1.

Step 82: Whether or not the value of the delay register D thus decremented has become "0" is detected. When the result is "0", the routine proceeds to next step whereas when the result is not "0", the routine returns and repeats the decrementing of the delay register D and the similar detection processing.

Step 83: When the value of the delay register D has become "0" as a result of the decrementing processing, the value stored in the velocity register V at this time point is supplied to the tone source circuit 17 for tone generation.

An example of operation following the flow charts of FIGS. 10 and 11 will now be described.

Description will be made about a case where, as a result of the bar counter processing and the beat counter processing, the performance data at address "1" of the performance data pattern PD of FIG. 7A is read out for tone generation.

Since the data "KON" representing key-on, data "37" representing its note number and data "105" representing its velocity V are stored at address "1" of the performance data pattern PD, in the performance data reading processing, the performance data is read from address "1" of the performance data pattern PD of FIG. 7A.

Since the data at address "1" of the performance data pattern PD is performance data, then change data is read from address "1" of the change data pattern CD of FIG. 7B.

At address "1" of the change data pattern CD, there are stored data "2" as the timing change value TM and data "10" as the velocity offset value VOF.

In the pedal value writing processing, the pedal value corresponding to the amount of depression of the foot pedal 21 is stored in the pedal register P. Cases where the pedal value stored in the pedal register P is "0", "0.5" and "1" will be described below.

In the case where the pedal value is "0", product of multiplication of the value of the pedal register P with the timing change value TM "2" of the change data is "0" and, therefore, the reference value DO only is stored i the delay register D. Since the reference value DO is a value for delaying the tone generation timing by time length corresponding to a quarter beat and the value of one beat is set at "96", the reference value DO is set to "24".

Since product of multiplication of the value of the pedal register P with the velocity offsets value VOF of 1135 the change data is also "0", the velocity VEL which is "106" of the performance data is directly stored in the velocity register V.

The interrupt processing of FIG. 11 is repeated 24 times and, when the contents of the delay register have become "0", tone generation of a tone corresponding to the note number "37" and the velocity "106" is performed.

When the pedal value is "0.5", produces of multiplication of the value "0.5" of the pedal register P with the timing change value TM which is "2" is "1" and, therefore, data "25" which is the sum of the reference value DO "24" with "9" is stored in the delay register D.

Since product of the pedal value P which is "0.5" with the velocity offset value VOF of the change data which is "10" is data "111" which is the sum of the velocity VEL of the performance data which is "106" and "5" is stored in the velocity register V.

When the interrupt[i processing of FIG. 11 has been repeated 25 times and the contents of the delay register D have become "0", tone generation of a tone corresponding to the note number "37" and the velocity "111" is performed.

When the pedal value is "1", product of multiplication of the value "1" of the pedal register P with the timing change value TM which is "2" of the change data is "2" and, therefore, data "26" which is the sum of the reference value DO which is "24" and "2" is stored in the delay register D.

Since product of multiplication of the value "1" of the pedal register P with the velocity offset value VOF of the change data which is "10" is "10", data "116" which is the sum of the velocity VEL which is "106" of the performance data and "10" is stored in the velocity register V.

The interrupt processing of FIG. 11 is repeated 26 times and, when the contents of the delay register D have become "0", tone generation of a tone corresponding to the note number "37" and the velocity "116" is performed.

Then, a similar processing is made with respect to the performance data at address "2" of the performance pattern data. At this ! time, by changing contents of the change data pattern by operating the dial 26, a processing for changing the performance data is performed and, by changing the amount of depression of the foot pedal 21, contents of change of the performance data undergo a subtle change whereby expression of the automatic performance can be improved. In a case where the result of multiplication of the pedal value with the change data extends to a decimal, the lower bit representing the decimal is neglected, i.e., discarded.

In the above described embodiments, description has been made about the electronic musical instrument. The invention is applicable also to a device in which a sequencer module performing an automatic performance and a tone source module including a depressed key detection circuit and a tone source circuit are constructed separately from each other and exchange of data between the respective modules is made on the basis of the MIDI standard.

A computer may be connected in place of the depressed key detection circuit 13 and the keyboard 19 and desired performance data may be applied.

In the above described embodiments, description has been made about a case where a positive value within a range of 0 to 1 is produced by the foot pedal 21. Alternatively, an arrangement may be made so that 0 is produced when the position of depression of the foot pedal 21 is medium and values of +1 to −1 are produced by displacing from the 0 position depending upon the amount of depression. A value larger than 1 may also be produced.

In the embodiment of FIGS. 6 to 11, description has been made about a case where the address of the performance data is 96. The invention however is not limited to this but the address may be smaller or larger. The performance data has been described as being made by combining data for one bar but it may be made by combining data of several bars.

In the embodiment of FIGS. 6 to 11, description has been made about a case where the timing is changed in accordance with contents of the change data with respect to all performance data. Alternatively, the change data become valid only with respect to specific data in the performance data, e.g., performance data concerning key-on and invalid with respect to other performance data and no change processing is made with respect to such other performance data. Further, the change in the change data which has been performed once during actual performance may be stored in a memory and the stored data may be reproduced for use in thee change processing In the embodiment of FIGS. 6 to 11, the example of data format which the address advances at a constant speed in correspondence to the time of performance. The invention is not limited to this but a similar result can be obtained by modifying, in a system in which performance data is stored with timing data corresponding to time elapsed from the beginning of the bar, the timing data and velocity data suitably.

In the embodiment of FIGS. 1 to 5, description has been made about a case where interpolation is performed with respect to all performance data. The invention however is not limited to this but specific data in the performance data, e.g. performance data concerning the on timing, only may be interpolated and tone generation may be performed on the basis of data of the first or second channel with respect to other performance data.

In the embodiment of FIGS. 1 to 5, the note number is selected from either the performance data of the first channel or the performance data of the second channel on the basis of the pedal signal a. Alternatively, which note number should be given priority may be determined by a panel switch or other means.

In the embodiment of FIGS. 1 to 5, description has been made about a case where the interpolation data is changed in real time by the pedal. The invention however is not limited to this but the interpolation data may be provided as data for each piece or each bar. It may be made settable be may be made variable by operation of a volume slider or other operator. A real time change of the interpolation data which has been made during actual performance may be directly stored in a memory and may be reproduced during performance. Further, a music piece to be performed may be composed by sequencing plural automatic performance data patterns. In this case the first channel pattern and the second channel pattern may preferably be stored as one set.

In the embodiment of FIGS. 1 to 5, the arrangement is made so that some interpolation data is always obtained notwithstanding that the performance data of the first channel is independent from the performance data of the second channel and there is no particular correlationship therebetween. Alternatively, for providing change in musical expression effectively, specific data may be provided exclusively to each channel. In this case, for providing clear correspondence between data to be interpolated, data representing the order may be separately provided. By this arrangement, the detection of the threshold value used in step 55 in FIG. 5 becomes unnecessary.

In the embodiment of FIGS. 1 to 5, description has been made about a case where the performance data of the two channels are interpolated. The invention is not limited to this but performance data of three or more channels may be interpolated or performance data of two suitable channels may be selected from among performance data of plural channels and these performance data of the two selected channels may be interpolated.

In the embodiment of FIGS. 1 to 5, description has been made taking by the way of example the event system in which tone pitch information and tone generation control information are imparted and stored only for timing at which a tone generation event as performance data takes place. The invention however is not limited to this but it is applicable also to a system in which tone pitch information and tone generation control information are sequentially stored at addresses corresponding to all tempo clocks.

Further, although the embodiments have been described in connection with an automatic sequence performance of scale notes, the present invention is also applicable to various other kinds of automatic performances, such as an automatic sequence performance of rhythm sounds, automatic bass chord performance and automatic rhythm performance.

According to the invention, a desired change can be imparted to performance data to be performed and a subtle change can be imparted to a tone generation timing of each individual tone to be generated.

Further, according to the invention, plural types of change data for changing reference performance data are provided in addition to the reference performance data and the player can selectively use, during the automatic performance, desired change data which best suits the elevated state of his feeling whereby an automatic performance which is rich in expression of the player's feeling as in a live performance can be provided.

Further, according to the invention, not only performance data which is stored in correspondence to a reference timing but also data for changing this timing are stored and the player can use this data for changing the performance whereby an automatic performance which is rich in expression as in a live performance can be provided such as "delayed-play" or "rush-play" concerning the performance timing.

What is claimed is:

1. An automatic performance device comprising:

performance data memory means for storing automatic performance data of plural channels;

interpolation data setting means for variably setting interpolation data for interpolating the performance data of plural channels;

reading means for reading out the respective automatic performance data of plural channels;

interpolation means for interpolating the read out automatic performance data of plural channels on the basis of the interpolation data; and automatic performance means for performing an automatic performance on the basis of the interpolated automatic performance data.

2. An automatic performance device as defined in claim 1 wherein said interpolation data setting means is an operator producing an output value in analog form.

3. An automatic performance device as defined in claim 1 wherein said automatic performance data contains tone generation start timing information and said interpolation means interpolates the tone generation start timing information of plural channels.

4. An automatic performance device as defined in claim 1 wherein said automatic performance data contains tone generation duration information and said interpolation means interpolates the tone generation duration information of plural channels.

5. An automatic performance device as defined in claim 1 wherein said automatic performance data contains velocity information and said interpolation means interpolates the velocity information of plural channels.

6. An automatic performance device as defined in claim 1 wherein said automatic performance data contains tone pitch information and said interpolation means selects tone pitch information of one channel among the automatic performance data of plural channels.

7. An automatic performance device as defined in claim 1 wherein said automatic performance data contains tone generation start timing information and said interpolation means interpolates performance data which have a difference within a predetermined value in a tone generation start timing among the automatic performance data of plural channels.

8. An automatic performance device comprising:

performance data memory means for storing reference performance data;

change data memory means for storing plural types of change data for changing the reference performance data;

a data selection operator for selecting a desired type of change data from among the plural types of change data stored in said change data memory means;

data changing means for changing the reference performance data on the basis of the change data selected by said data selection operator; and automatic performance means for performing an automatic performance on the basis of the changed performance data.

9. An automatic performance device as defined in claim 8 wherein said reference performance data contains plural event information corresponding to advance of a music piece and said change data changes a timing of generation of the event information.

10. An automatic performance device as defined in claim 8 wherein said reference performance data contains velocity information and said change data changes the velocity information.

11. An automatic performance device as defined in claim 8 further comprising control means for variably controlling the amount of change of the performance data which is changed by said data changing means.

12. An automatic performance device as defined in claim 8 wherein at least one type of said change data includes plural change data patterns each consisting of plural change data corresponding to a predetermined performance duration and a plurality of pattern sequence data for arranging these change data patterns in a predetermined order according to advance of a music piece, and said data selection operator selects one of the pattern sequence data.

13. An automatic performance device comprising:

performance data memory means for storing performance data in correspondence to a reference performance timing;

change data memory means for storing change data for changing the performance timing of the performance data; and performance means for reading the performance data from said performance data memory means and the change data from said change data memory means and making a performance by changing the reference performance timing of the performance data on the basis of the read out change data, said performance means reading the performance data sooner by predetermined time length than a timing of actual performance and determining the timing of actual performance by changing the performance timing corresponding to the read out performance data by the change data.

14. An automatic performance device as defined in claim 13 further comprising variable control means for variably controlling an amount of change indicated by the read out change data.

15. An automatic performance device comprising:

performance data memory means for storing reference performance data;

change data pattern memory means for storing plural change data patterns for changing the reference performance data;

sequence memory means for storing pattern sequence information which designates sequentially the respective change data patterns in a predetermined order;

control means for variably controlling an amount of change indicated by the change data pattern designated by the pattern sequence information;

data change means for changing the reference performance data on the basis of the variably controlled change data pattern; and automatic performance means for performing an automatic performance on the basis of the changed performance data.

16. An automatic performance device comprising:

performance data memory means for storing reference performance data;

change data memory means for storing plural types of change data for changing the reference performance data;

data selection means for selecting desired change data from among the plural change data stored in said change data memory means;

variable control means for variably controlling an amount of change indicated by the change data selected by said data selection means;

data changing means for changing the reference performance data on the basis of the variably controlled change data; and automatic performance means for performing an automatic performance on the basis of the changed performance data.

* * * * *